United States Patent [19]

Shulman

[11] 4,332,103

[45] Jun. 1, 1982

[54] MODEL AIRCRAFT GLIDER

[75] Inventor: Leon Shulman, Metuchen, N.J.

[73] Assignee: Life-Like Products, Inc., Baltimore, Md.

[21] Appl. No.: 163,426

[22] Filed: Jun. 27, 1980

[51] Int. Cl.[3] ..... A63H 27/14

[52] U.S. Cl. ..... 46/81

[58] Field of Search ..... 46/79, 80, 81, 74 B, 46/74 A

[56] References Cited

U.S. PATENT DOCUMENTS

| | | | |
|---|---|---|---|
| D. 231,478 | 4/1974 | Lee | D34/18 H |
| D. 232,650 | 9/1974 | Martin | D34/15 HH |
| D. 237,291 | 10/1975 | Meffert | D34/15 HH |
| D. 249,378 | 9/1978 | Takahashi | D21/01 |
| D. 251,454 | 3/1979 | Takahashi | D21/01 |
| 2,009,252 | 7/1935 | Erickson | 46/81 |
| 2,315,242 | 3/1943 | Briggs et al. | 46/81 |
| 2,993,297 | 7/1961 | Bednar et al. | 46/81 X |
| 3,084,477 | 4/1963 | Whatley | 46/81 |
| 3,177,612 | 4/1965 | Giossi | 46/81 |
| 3,246,425 | 4/1966 | Miller | 46/79 |
| 3,408,767 | 11/1968 | Anderson | 46/80 |
| 3,898,763 | 8/1975 | Rizzo | 46/79 |
| 3,898,765 | 8/1975 | Lee | 46/81 |
| 3,918,197 | 11/1975 | Stanzel | 46/81 |
| 4,064,647 | 12/1977 | Lemelson | 46/81 |

*Primary Examiner*—F. Barry Shay

*Attorney, Agent, or Firm*—Shapiro and Shapiro

[57] ABSTRACT

A model aircraft glider includes a wing and a fuselage having a resilient nose bumper for absorbing the impact of a collision. The glider has a finger-receiving recess centrally located on an underside thereof near the bumper to facilitate launching of the glider by an operator. The glider further includes a centrally located projection which is cooperable with the finger-receiving recess for hand launching and is cooperable with a resilient member for catapult launching.

14 Claims, 8 Drawing Figures

MODEL AIRCRAFT GLIDER

BACKGROUND OF THE INVENTION

This invention relates generally to model aircraft and more particularly to model aircraft gliders.

Model aircraft gliders are commonly hand launched into the air, the glider being grasped by an operator and thrown. Providing convenient and proper grasping surfaces for hand launching is sometimes a problem, particularly if good aerodynamic characteristics are to be maintained. Since gliders are made from lightweight materials, if they are improperly grasped for hand launching, e.g., at a wing tip, breakage or other damage may result. Moreover, it is sometimes difficult to project the glider in the desired direction when it is thrown. If the glider is grasped too far forward, it may have a tendency to nose dive; if it is grasped too far to the rear, it may have a tendency to loop or flip over.

Another problem associated with model aircraft gliders is that many of the lightweight materials from which the gliders are formed are susceptible to permanent deformation or breakage due to the impact of a collision by the glider with another object. Since most collisions involve the nose of the glider, it is known to include an impact-absorbing nose member on gliders. However, many such impact-absorbing members are not completely effective in preventing damage. This is particularly true where the nose of the glider is rounded or bullet-shaped in the traditional manner, since the impact force transmitted to the glider tends to be confined to a relatively small area and, accordingly, produces high stresses.

SUMMARY OF THE INVENTION

It is accordingly a principal object of the invention to provide a new and improved model aircraft glider.

A further object of the invention is to provide a glider having improved hand-launching means.

Another object of the invention is to provide a new and improved glider capable of both catapult launching and hand launching.

An additional object of the invention is to provide a new and improved glider in which damage to the glider due to collison with another object is minimized.

A still further object of the invention is to provide an improved glider having good aerodynamic characteristics.

Briefly stated, in one aspect, a glider in accordance with the invention may include a wing and a fuselage, the glider having a finger-receiving recess centrally located on its underside near its nose to facilitate launching of the glider by an operator.

In accordance with another aspect of the invention, a glider comprises a fuselage and a wing formed as a unitary structure of rather rigid molded plastic foam, and a resilient cellular bumper attached to the forward end of the fuselage for absorbing the force of an impact on the glider, the resiliency of the bumper being substantially greater than the resiliency of the foam.

DESCRIPTION OF THE PREFERRED EMBODIMENT

Figure 1:
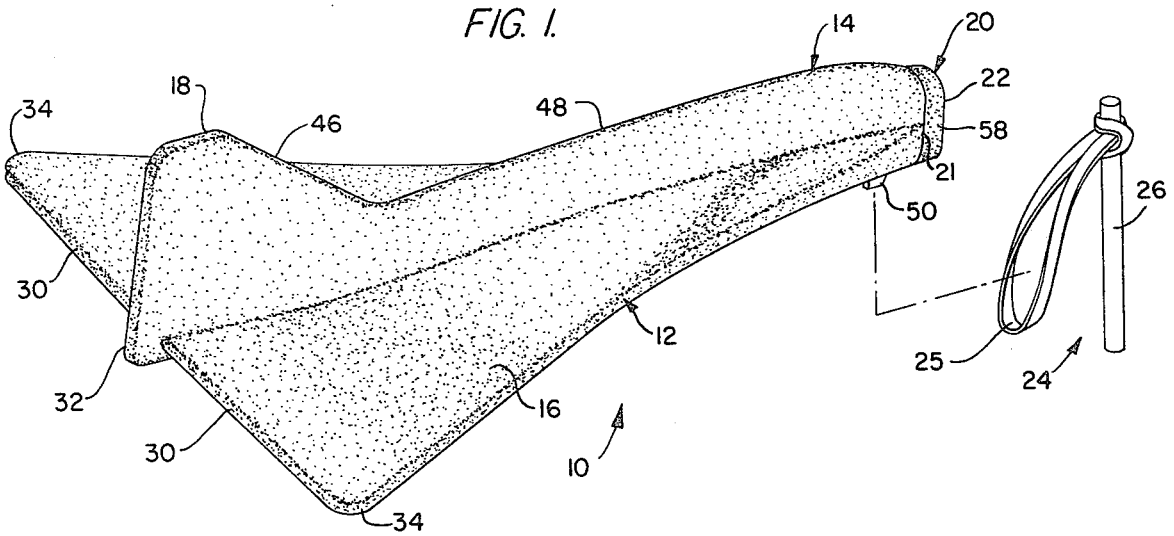
FIG. 1 is a perspective view illustrating a glider in accordance with the invention and an associated catapult launcher.

As shown in the figures, a model aircraft glider 10 in accordance with the invention generally comprises a delta wing airfoil 12 having a fuselage 14 centrally positioned on an upper surface 16 thereof. A portion of the fuselage projects rearwardly and upwardly to form a vertical stabilizer 18. As shown in the drawings, the fuselage and the wing are substantially coextensive longitudinally. Preferably, wing 12 and fuselage 14 are formed as a unitary structure of a rather rigid molded lightweight plastic, such as styrofoam. A catapult launcher 24 (FIG. 1) comprising a resilient member 25, such as a rubber band, attached to a handle 26 may also be provided for catapult launching of the glider, in a manner which will be explained.

An impact-absorbing member or bumper 20, preferably of a resilient cellular material, such as foam rubber, which has a resiliency substantially greater than the resiliency of the plastic from which the wing and the fuselage are molded, is attached to the forward end or nose 21 of the fuselage 14 to form the nose of the glider. Bumper 20 may be attached to the fuselage with well-known adhesives, for example. As shown in the figures, bumper 20 is shaped to conform generally with the shape of the fuselage in order to preserve its aerodynamic lines. The bumper has a flat frontal portion 22 which is substantially coextensive with the flat forward end 21 of the fuselage. The frontal portion of the bumper presents a relatively large surface area for absorbing impact forces and for distributing them over the relatively large surface of the forward end 21 of the fuselage. This reduces the stresses in the glider caused by an impact, and permits the bumper to be made of a relatively soft resilient material so that it absorbs most of the impact force, thus minimizing the possibility of damage.

Figure 2:
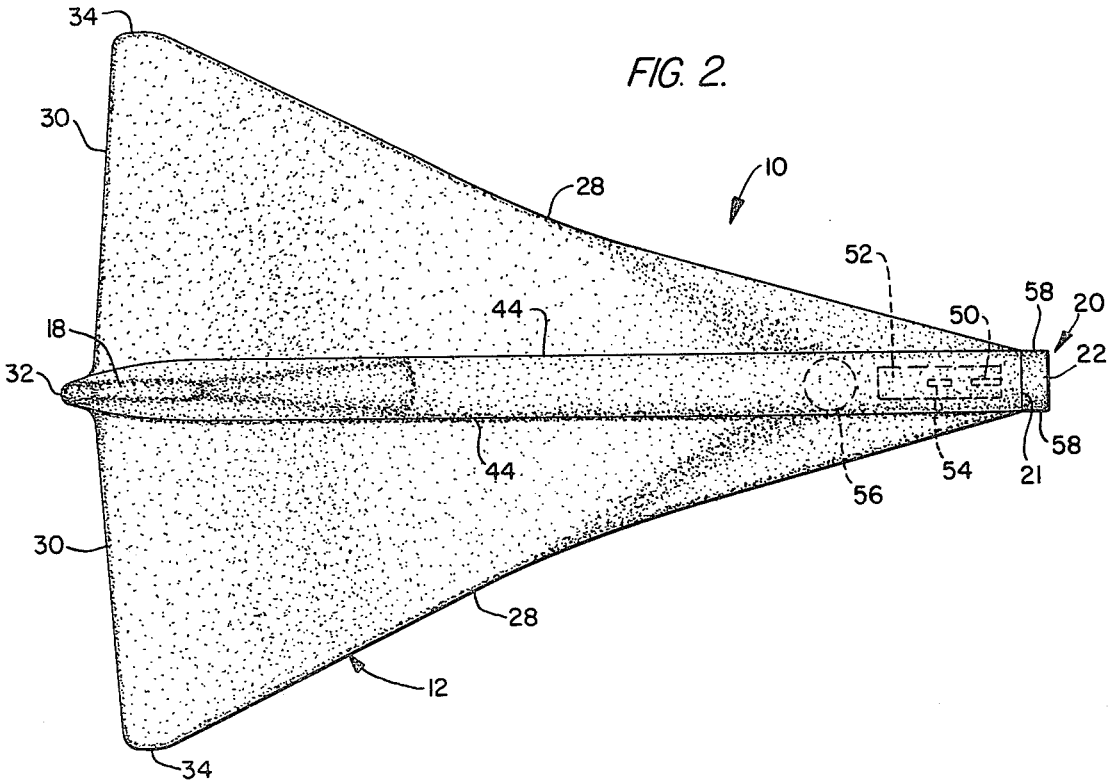
FIG. 2 is a top plan view of the glider of FIG. 1.
Figure 3:
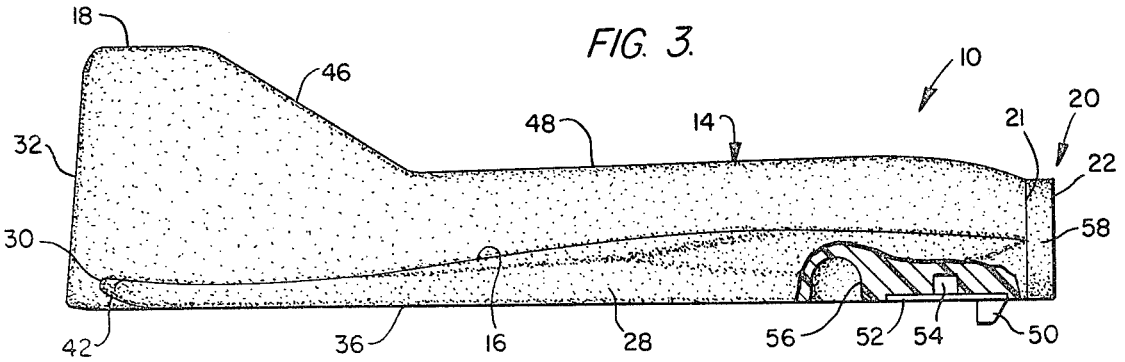
FIG. 3 is a side elevational view of the glider, partially broken away.
Figure 4:
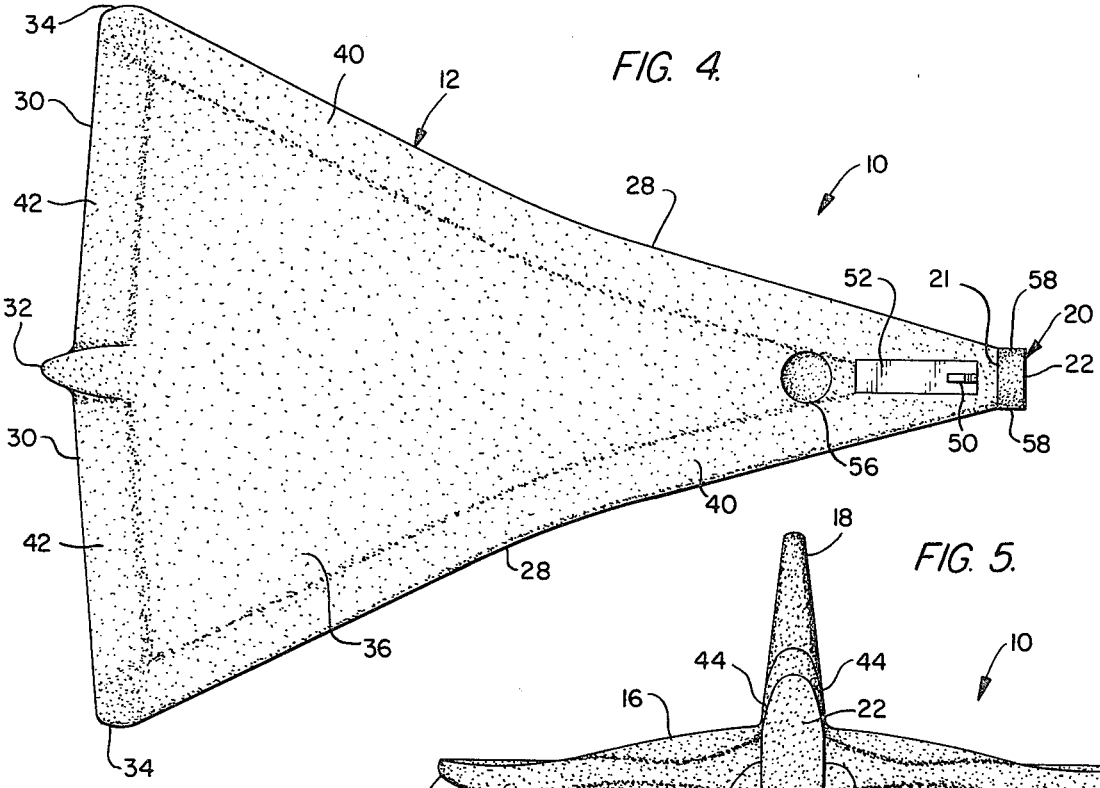
FIG. 4 is a bottom plan view of the glider.
Figure 5:
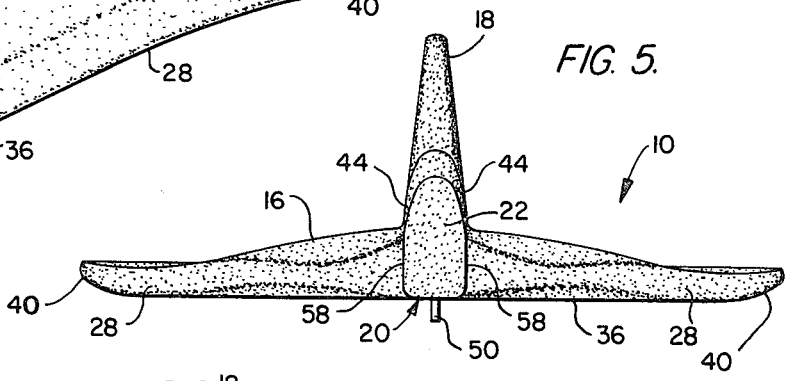
FIGS. 5 and 6 are, respectively, front and rear elevational views of the glider.
Figure 6:
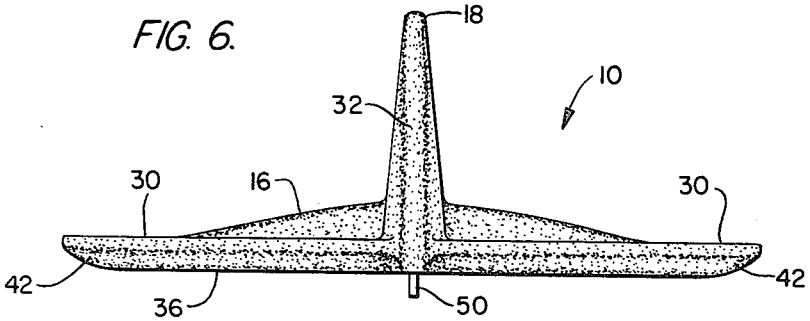

As illustrated in FIGS. 1, 2 and 4, wing 12 is swept back from nose 20 of the glider, the leading edges 28 of the wing preferably forming a smooth curve between the nose and the trailing edges 30 of the wing which are positioned adjacent to the trailing edge 32 of vertical stabilizer 18. The wing tips or pinions 34 connecting the leading and the trailing edges of the wing are preferably smoothly curved as shown. The underside 36 of the wing is preferably a substantially planar surface having its peripheral border regions 40, 42 adjacent to leading edges 28 and trailing edges 30, respectively, curved toward the upper surface 16 of the wing, as shown in FIGS. 3–6. Preferably, the upper surface 16 of the wing is smoothly tapered rearwardly from its thickest vertex portion adjacent to nose 20 to its trailing edges 30 (FIGS. 1 and 3), and is smoothly tapered outwardly from the sides 44 of the fuselage 14 to its leading edges 28 (FIGS. 5 and 6). The trailing edges 30 of the wing are preferably bent slightly upwardly in a shallow angle, as best illustrated in FIG. 3, to impart a slight climbing flight characteristic to the glider.

As shown in FIGS. 2 and 6, sides 44 of fuselage 14 are preferably smoothly tapered inwardly and upwardly along approximately their rear $\frac{1}{3}$ portion to form vertical stabilizer 18. As shown in FIGS. 1 and 3, the leading edge 46 of the vertical stabilizer slopes rearwardly and upwardly from the top 48 of the fuselage, and the trailing edge 32 of the vertical stabilizer slopes slightly forwardly as shown.

The illustrated shapes of the wing and fuselage of the glider have been selected to give the glider good aerodynamic balance and good flight characteristics. However, it will be appreciated by those skilled in the aerodynamic art that various modifications may be made to the glider to impart to it certain desired flight characteristics.

The glider may be launched either by hand or by using a catapult such as illustrated in FIG. 1, as will now be described.

Figure 8:
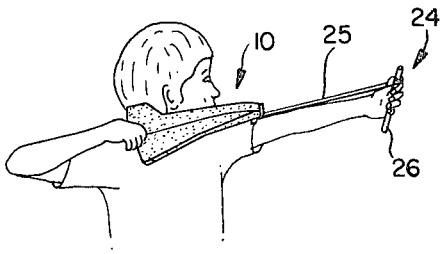
FIG. 8 is a perspective view illustrating catapult launching of the glider.

As best illustrated in FIG. 3, a depending hook 50 is located on the underside of wing 12 adjacent to nose 20 of the glider. Hook 50 may be integrally formed as a projection on one end of a substantially rectangular base 52 (FIG. 4) of rigid material, such as hard plastic (e.g. phenolic). Preferably, base 52 is attached to the glider, flush with the underside of the wing, when the glider is molded, and preferably it has a second centrally located projection 54 which is embedded into the glider, as shown. However, the glider may also be molded with a recess sized to receive base 52 and the base attached with adhesives. The elongated shape of base 52 and the embedded projection 54 strengthen the attachment of the base to the glider and help to prevent the hook and the base from being pulled out with use. Hook 50 is adapted to serve as a landing skid to protect the underside of the glider from damage when landing on a hard surface. Also, to permit catapult launching of the glider, hook 50 is adapted to be coupled to the resilient member 25 of catapult launcher 24, as indicated in FIG. 1. The glider may then be catapult launched in a well-known manner, as illustrated in FIG. 8.

A finger-receiving hole or recess 56 is also centrally located on the underside of the glider, preferably rearwardly of base 52, as shown in FIGS. 2–4. Recess 56 is sized to easily accommodate a finger of an operator, such as the index finger, to facilitate hand launching of the glider. As shown in the figures, in its preferred form the glider is a full delta wing design in which the wing extends to the forward end 21 of the fuselage. Moreover, the glider is preferably a low-wing design, the bottom of the wing being the bottom of the glider. With such designs, the sides of the fuselage cannot be grasped for hand launching, and it is very inconvenient to grasp the wing on its leading edges for this purpose. Accordingly, the sides 58 of bumper 20 and hook 50 provide convenient grasping surfaces which cooperate with recess 56 for holding the glider for hand launching.

To hand launch the glider, the sides 58 of bumper 20 may be grasped between the thumb and second finger, and the index finger positioned in recess 56. The glider is then thrown into the air. As it is thrown, bumper 20 may be released first and the index finger straightened to direct the glider in the desired direction. When bumper 20 is released, recess 56 allows the glider to pivot slightly on the index finger as it imparts a forward thrust to the glider. This permits better control of the direction in which the glider is thrown, and reduces the tendency of the operator to nose dive the glider or to flip it over.

Figure 7:
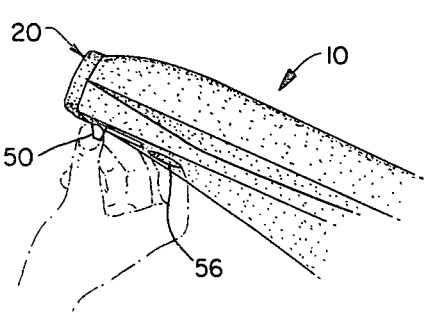
FIG. 7 is a fragmentary perspective view illustrating hand launching of the glider.

Hook 50 may also be used to hand launch the glider. As shown in FIG. 7, instead of grasping bumper 20, the thumb and second finger may be used to grasp hook 50, and the index finger positioned in recess 56 to hold the glider. The glider may then be launched in the manner described above, the hook being released first and the index finger being used to thrust the glider in the desired direction.

Recess 56 may also be used when launching the glider with catapult 24. Instead of grasping the vertical stabilizer, as shown in FIG. 8, the glider may be pulled back on resilient member 25 by an index finger placed in recess 56.

Surprisingly, the seemingly simple expedient of providing a finger-receiving recess 56 as described, positioned to cooperate with an impact-absorbing nose member, such as bumper 20, or to cooperate with a projection, such as hook 50, significantly enhances the hand-launching characteristics of the glider. Moreover, recess 56 advantageously allows aerodynamically conforming portions of the glider having good structural strength to be used as grasping surfaces, thereby preserving the glider's aerodynamic characteristics.

Depending upon the wind direction and the angle and speed at which the glider is launched, various stunts may be performed. For example, launching the glider upwardly and tilted slightly to one side causes it to circle in the direction in which it is tilted. Loops may be performed by launching the glider upwardly into the wind, or long gliding flights may be achieved by launching the glider upwardly with the wind.

By molding the glider as a unitary structure, good structural strength and resistance to damage due to collision with fixed objects are achieved. Moreover, its one-piece construction allows the glider to be aerodynamically balanced during manufacture, obviating the difficulties often encountered in balancing a glider assembled from a kit.

While the preferred embodiment of the invention has been shown and described, it will be apparent to those skilled in the art that changes can be made without departing from the principles and spirit of the invention, the scope of which is defined in the appended claims.

What is claimed is:

1. A model aircraft glider comprising a delta wing and a fuselage, the fuselage being centrally positioned on an upper surface of the wing and the fuselage and the wing being substantially of the same dimension longitudinally, the glider having a finger-receiving recess centrally located on its underside near the forward end of the fuselage, an impact-absorbing bumper attached to the forward end of the fuselage, the bumper having a substantially flat frontal portion, and having sides which extend beyond the forward end of the fuselage and the wing, the sides providing grasping surfaces, said surfaces and said recess being positioned sufficiently closely to each other to provide means for gripping the glider for hand launching.

2. The glider of claim 1, wherein the fuselage and wing are molded from plastic as a unitary structure.

3. The glider of claim 1, wherein the bumper is formed of a resilient cellular material having a resiliency greater than that of the fuselage and the wing.

4. A model aircraft glider comprising a delta wing and a fuselage, the fuselage being centrally positioned on an upper surface of the wing and the fuselage and the wing being substantially of the same dimension longitudinally, the glider having a finger-receiving recess centrally located on its underside near its nose to facilitate launching of the glider by an operator, and having a depending projection centrally located on its underside adjacent to its nose, the projection being spaced from the recess toward the nose of the glider and said projection and said recess being positioned sufficiently closely to each other to provide means for gripping the glider for hand launching.

5. The glider of claim 4, wherein the projection is adapted for engagement with resilient launching means for catapulting the glider into the air.

6. The glider of claim 4, wherein the projection is adapted to serve as a landing skid for the glider.

7. The glider of claim 4, wherein the projection is formed integrally on a rigid base which is attached to the glider flush with its underside.

8. The glider of claim 7, wherein the base includes a second projection embedded into the glider for strengthening the attachment between the base and the glider.

9. A model aircraft glider comprising a fuselage and a wing formed as a unitary structure of rather rigid molded plastic foam, a resilient cellular bumper attached to the forward end of the fuselage for absorbing the force of an impact on the glider, the resiliency of the bumper being substantially greater than the resiliency of the foam, and a finger-receiving recess centrally located on the underside of the glider rearwardly of the bumper, the recess and the bumper being positioned sufficiently closely to each other to provide means for gripping the glider for hand launching.

10. The glider of claim 9, wherein the forward end of the fuselage is flat, and wherein the bumper has a flat frontal portion substantially coextensive with said forward end and the shape of the bumper generally conforms to the shape of the fuselage.

11. The glider of claim 9, further comprising a projection positioned on the underside of the glider adjacent to the bumper and to the recess, the projection being cooperable with resilient launching means for catapulting the glider into the air and being cooperable with the recess to facilitate hand launching of the glider.

12. The glider of claim 11, wherein the projection is adapted to serve as a landing skid for the glider.

13. The glider of claim 9, wherein the glider is a full delta wing design.

14. The glider of claim 9, wherein the glider is a low-wing design.

* * * * *